US007541529B1

(12) United States Patent
Blair

(10) Patent No.: US 7,541,529 B1
(45) Date of Patent: Jun. 2, 2009

(54) GUITAR MOUNTING DEVICE

(76) Inventor: Billy W. Blair, P.O. Box 1278, Bethel Island, CA (US) 94511

( * ) Notice: Subject to any disclaimer, the term of this patent is extended or adjusted under 35 U.S.C. 154(b) by 0 days.

(21) Appl. No.: 11/832,185

(22) Filed: Aug. 1, 2007

(51) Int. Cl.
*G10D 3/00* (2006.01)

(52) U.S. Cl. ..... 84/327; 84/329; 224/910; 224/257; 248/302; 248/443

(58) Field of Classification Search ..... 84/327, 84/329; 224/910, 257; 24/324; 248/302, 248/443
See application file for complete search history.

(56) References Cited

U.S. PATENT DOCUMENTS 2,349,264 A * 5/1944 Grice ..... 2/322
2,961,725 A * 11/1960 McGee ..... 114/361
3,237,502 A * 3/1966 Moseley ..... 84/267
3,664,224 A * 5/1972 Campagna, Jr. ..... 84/327
3,765,633 A * 10/1973 Caudill ..... 248/229.12
3,970,228 A * 7/1976 Keller ..... 224/251
4,084,778 A * 4/1978 Dominguez ..... 248/314
4,254,901 A * 3/1981 McIntosh ..... 224/258
4,345,732 A * 8/1982 Gallegos ..... 248/201
D270,120 S * 8/1983 McPherson, Sr. ..... D6/567
4,402,560 A * 9/1983 Swainbank ..... 439/37
4,446,997 A * 5/1984 Himberg ..... 224/578
D283,032 S * 3/1986 Quesnel ..... D17/20
4,608,734 A * 9/1986 Schiller ..... 24/104
4,742,751 A * 5/1988 Cherry ..... 84/327
D297,683 S * 9/1988 Beauchan ..... D3/218
4,959,890 A * 10/1990 Pazurek ..... 24/113 MP
4,991,809 A * 2/1991 Harkey ..... 248/229.12
4,993,127 A * 2/1991 Mechem et al. ..... 24/701
5,031,868 A * 7/1991 Thomas, II ..... 248/283.1
D335,136 S * 4/1993 McMichael ..... D17/20
5,202,527 A * 4/1993 Gracie ..... 84/327
5,313,866 A * 5/1994 Smith ..... 84/327
5,346,168 A 9/1994 Astrella
5,363,734 A * 11/1994 Wilenken ..... 84/327
5,388,743 A * 2/1995 Silagy ..... 224/264
5,458,267 A * 10/1995 Curtis et al. ..... 224/675
5,645,256 A * 7/1997 Thomas, II ..... 248/222.11
D400,561 S * 11/1998 Vargas-Phillips ..... D17/20
6,231,018 B1 * 5/2001 Barbieri ..... 248/302
6,757,942 B2 * 7/2004 Matsui et al. ..... 24/114.4
6,835,883 B2 * 12/2004 Stevens ..... 84/453
6,892,428 B2 * 5/2005 Reiter ..... 24/303
7,169,992 B1 * 1/2007 Kennon ..... 84/327
7,375,269 B2 * 5/2008 Perkins ..... 84/327
7,446,249 B2 * 11/2008 Driscoll ..... 84/327
2002/0062539 A1 * 5/2002 Matsushima et al. ..... 24/114.4
2004/0094585 A1 * 5/2004 Walker ..... 224/257
2005/0000348 A1 * 1/2005 Workman ..... 84/327

(Continued)

*Primary Examiner*—Jeffrey Donels
*Assistant Examiner*—Robert W Horn
(74) *Attorney, Agent, or Firm*—Crossley Patent Law; Mark Ashley Crossley

(57) ABSTRACT

A guitar mounting device that allows an individual, particularly a guitar player, to mount his or her guitar on the side of an amplifier. The device is fabricated from a leather strap attached to the side of an amplifier casing and also a number of slits so that a guitar with an external button can be connected to one of the slits. In addition, the device includes a wire frame and an attachable, flexible cord that allows the neck of the guitar neck to be secured to the device.

3 Claims, 5 Drawing Sheets

U.S. PATENT DOCUMENTS

2006/0032359 A1* 2/2006 Smith ..... 84/327
2006/0225255 A1* 10/2006 Kawensky ..... 24/324
2008/0028913 A1* 2/2008 Driscoll ..... 84/327

* cited by examiner

FIG. 4
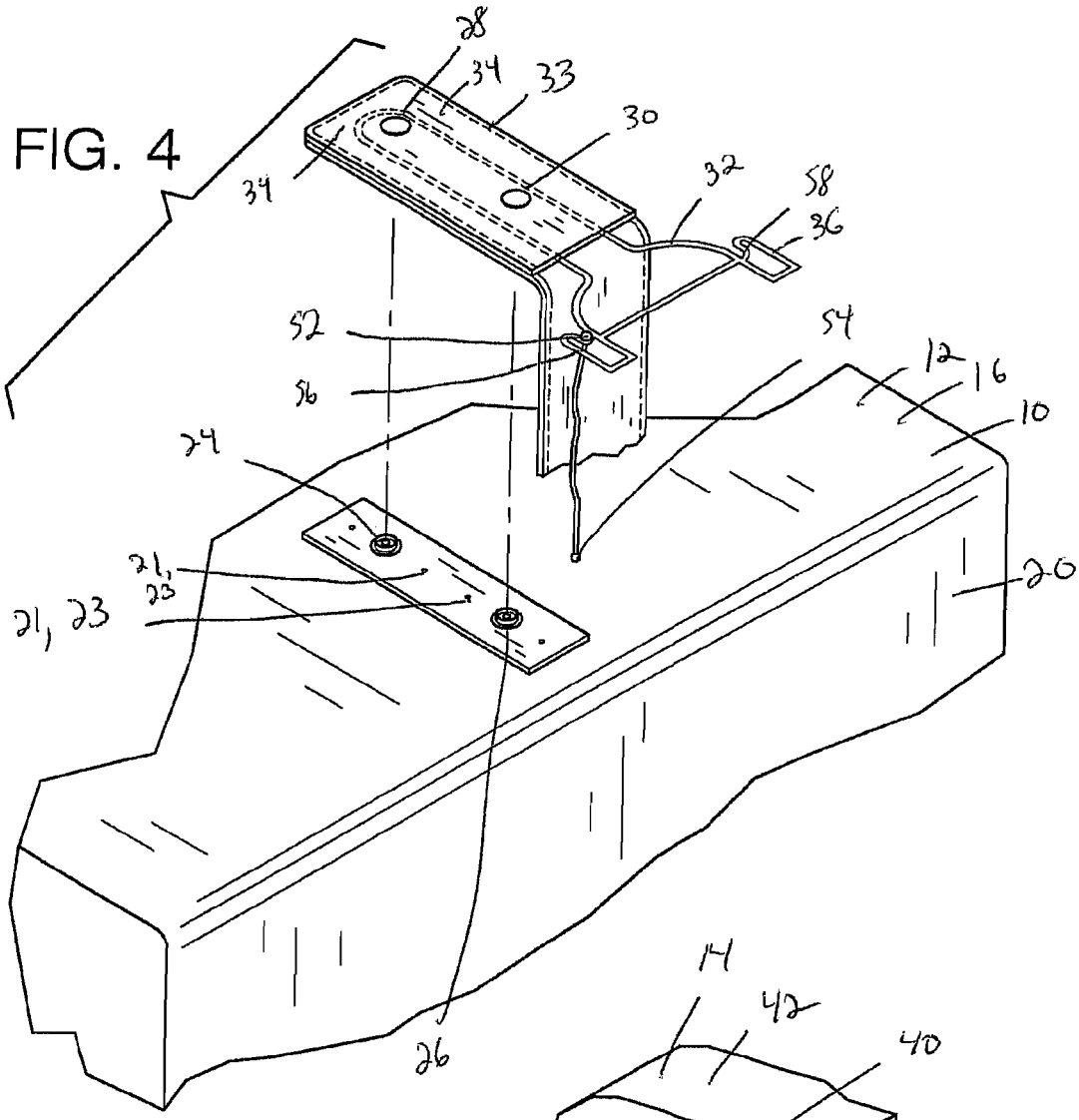
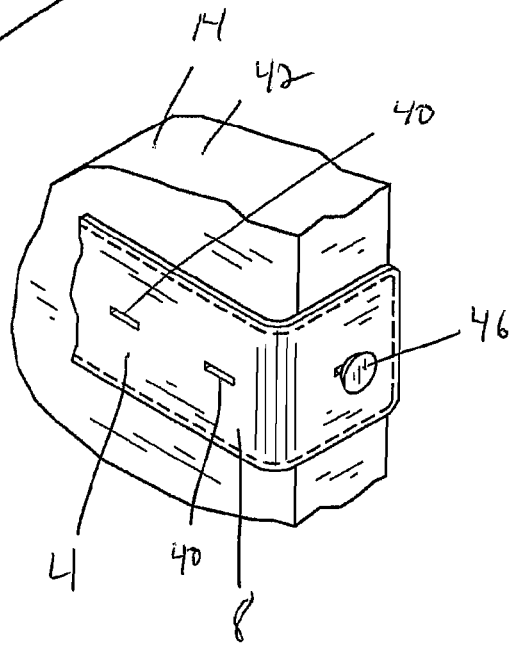
FIG. 5

GUITAR MOUNTING DEVICE

BACKGROUND OF THE INVENTION

The present invention concerns that of a new and improved guitar mounting device that allows an individual, particularly a guitar player, to mount his or her guitar on the side of an amplifier.

DESCRIPTION OF THE PRIOR ART

U.S. Pat. No. 4,345,732, issued to Gallegos, discloses a supporting bracket for musical instruments.

U.S. Pat. No. 4,084,778, issued to Dominguez, discloses a bracket for supporting stringed musical instruments.

U.S. Pat. No. 3,664,224, issued to Campagna, Jr., discloses a strap around an amplifier to hold a guitar.

U.S. Pat. No. 5,346,168, issued to Astrella, discloses a guitar hanging fixture which is attached to an amplifier.

U.S. Pat. No. 5,313,866, issued to Smith, discloses an adjustable guitar which is attached to an amplifier.

SUMMARY OF THE INVENTION

The present invention concerns that of a new and improved guitar mounting device that allows an individual, particularly a guitar player, to mount his or her guitar on the side of an amplifier. The device is fabricated from a leather strap attached to the side of an amplifier casing and also a number of slits so that a guitar with an external button can be connected to one of the slits. In addition, the device includes a wire frame and an attachable, flexible cord that allows the neck of the guitar neck to be secured to the device.

There has thus been outlined, rather broadly, the more important features of a guitar mounting device that the detailed description thereof that follows may be better understood and in order that the present contribution to the art may be better appreciated. There are, of course, additional features of the guitar mounting device that will be described hereinafter and which will form the subject matter of the claims appended hereto.

In this respect, before explaining at least one embodiment of the guitar mounting device in detail, it is to be understood that the guitar mounting device is not limited in its application to the details of construction and to the arrangements of the components set forth in the following description or illustrated in the drawings. The guitar mounting device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present guitar mounting device. It is important, therefore, that the claims be regarded as including such equivalent constructions insofar as they do not depart from the spirit and scope of the present invention.

It is therefore an object of the present invention to provide a guitar mounting device which has all of the advantages of the prior art and none of the disadvantages.

It is another object of the present invention to provide a guitar mounting device which may be easily and efficiently manufactured and marketed.

It is another object of the present invention to provide a guitar mounting device which is of durable and reliable construction.

It is yet another object of the present invention to provide a guitar mounting device which is economically affordable and available for relevant market segment of the purchasing public.

Other objects, features and advantages of the present invention will become more readily apparent from the following detailed description of the preferred embodiment when considered with the attached drawings and appended claims.

BRIEF DESCRIPTION OF THE DRAWINGS

FIG. 4 shows a close-up perspective view of the leather strap and the associated mounting plate after the mounting plate has been attached to the amplifier.

FIG. 5 shows a close-up perspective view of the guitar head as it appears placed against the mounting platform.

DESCRIPTION OF THE PREFERRED EMBODIMENT

Figure 1:
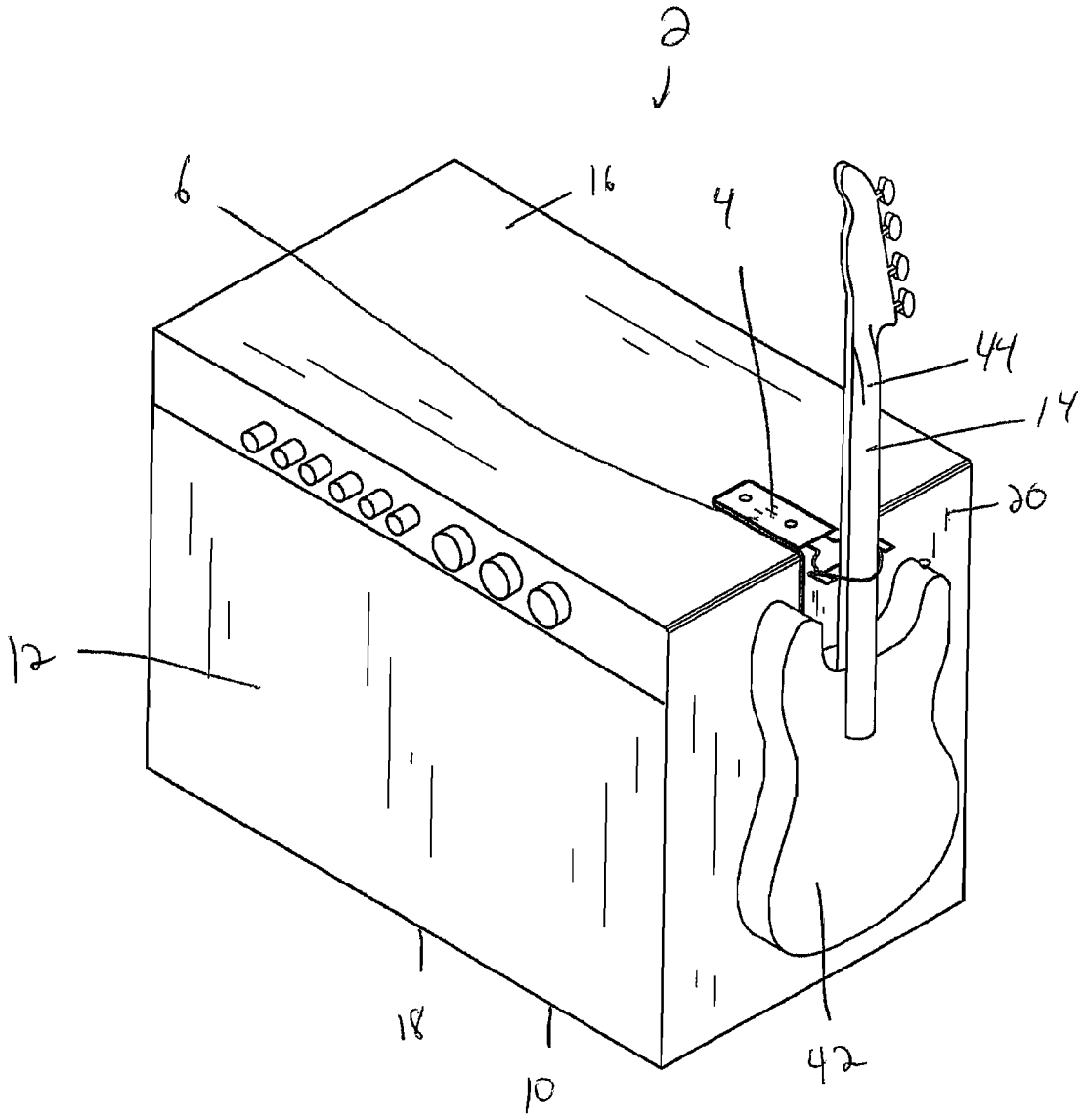
FIG. 1 shows a perspective view of the guitar mounting device as it appears attached to an amplifier and in use with a mounted guitar.
Figure 2:
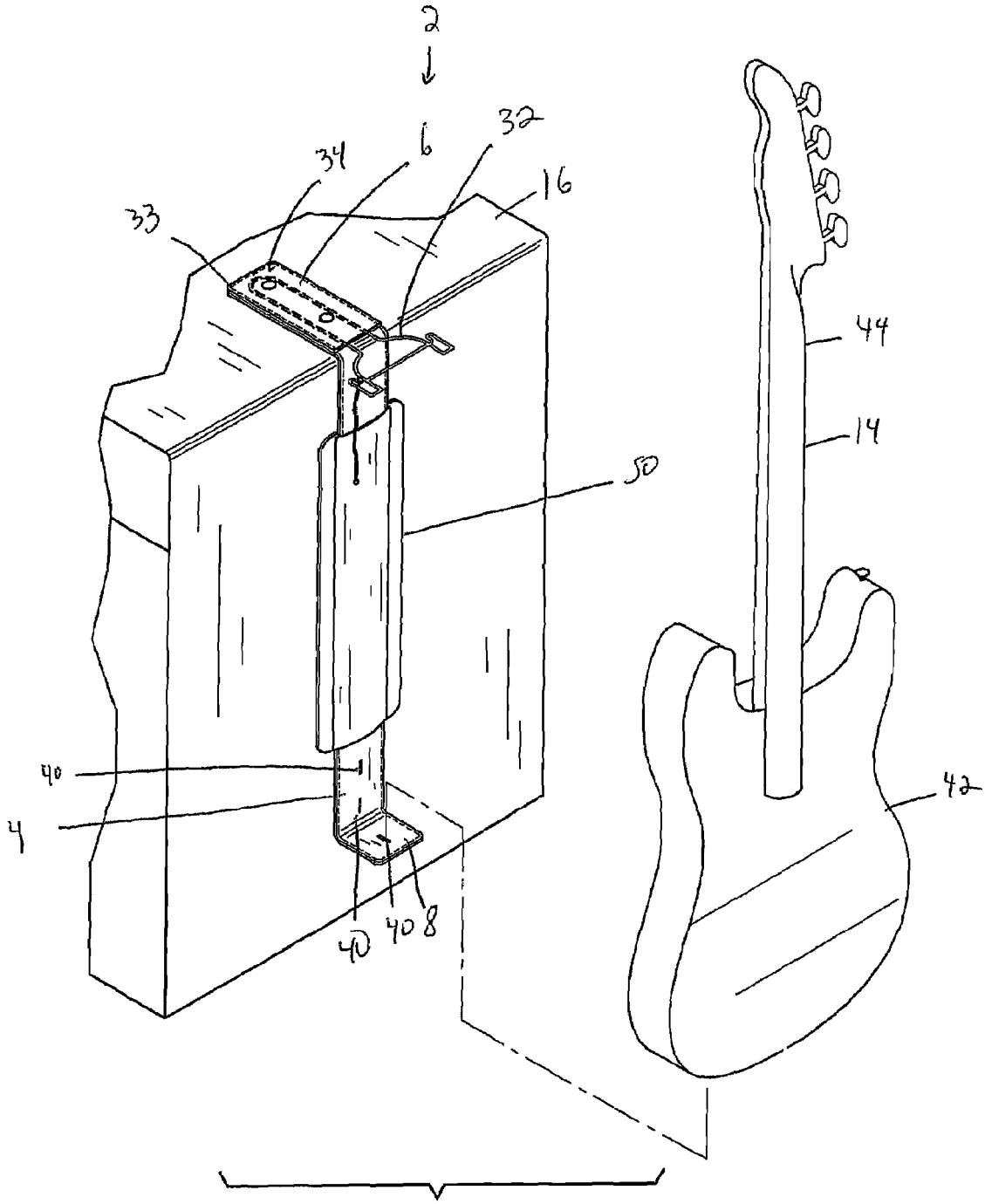
FIG. 2 shows a perspective view of the guitar mounting device, highlighting how a guitar is attached to the device.
Figure 3:
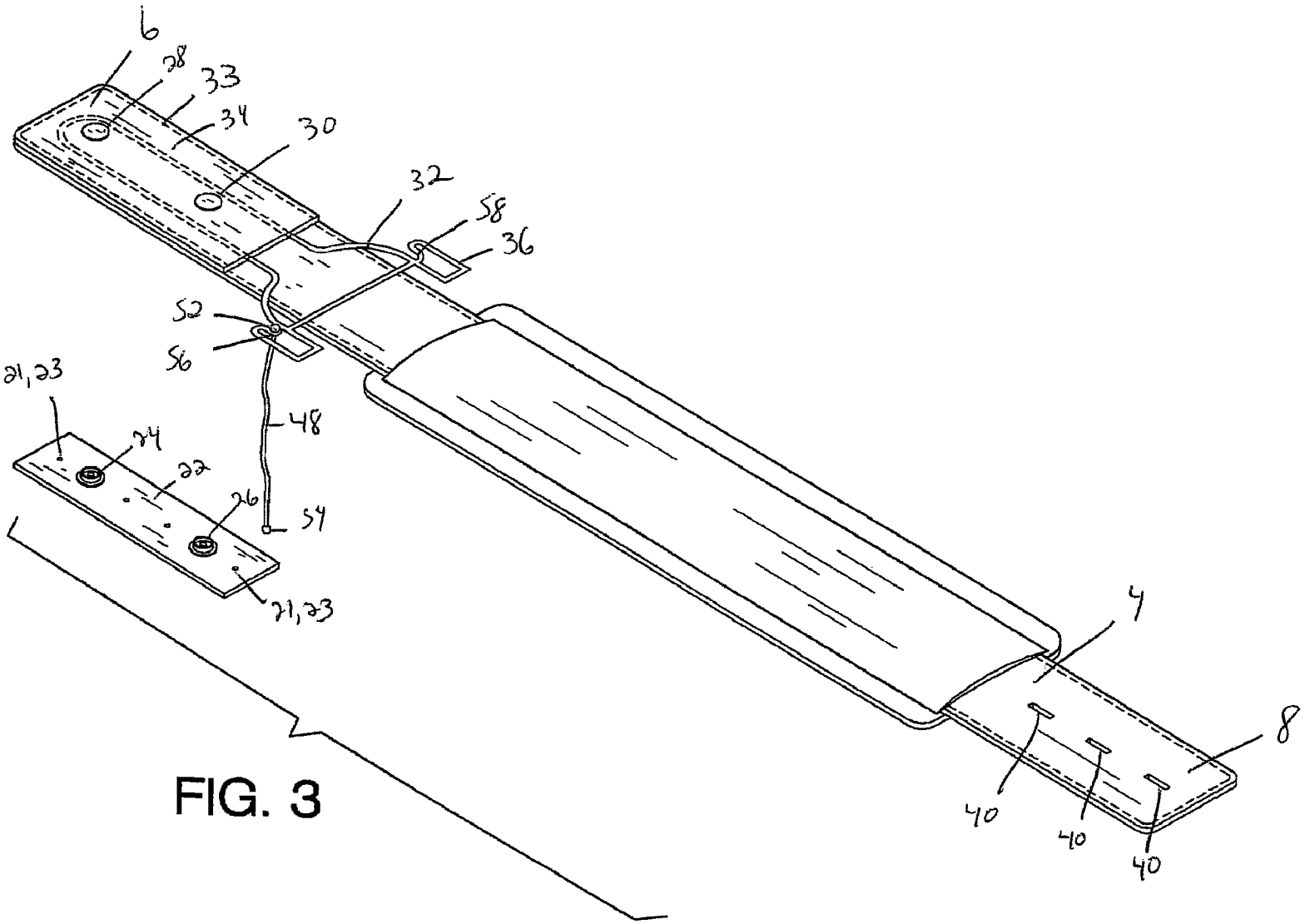
FIG. 3 shows a perspective view of the leather strap and the associated mounting plate that is used to attach the leather strap to the amplifier.
Figure 6:
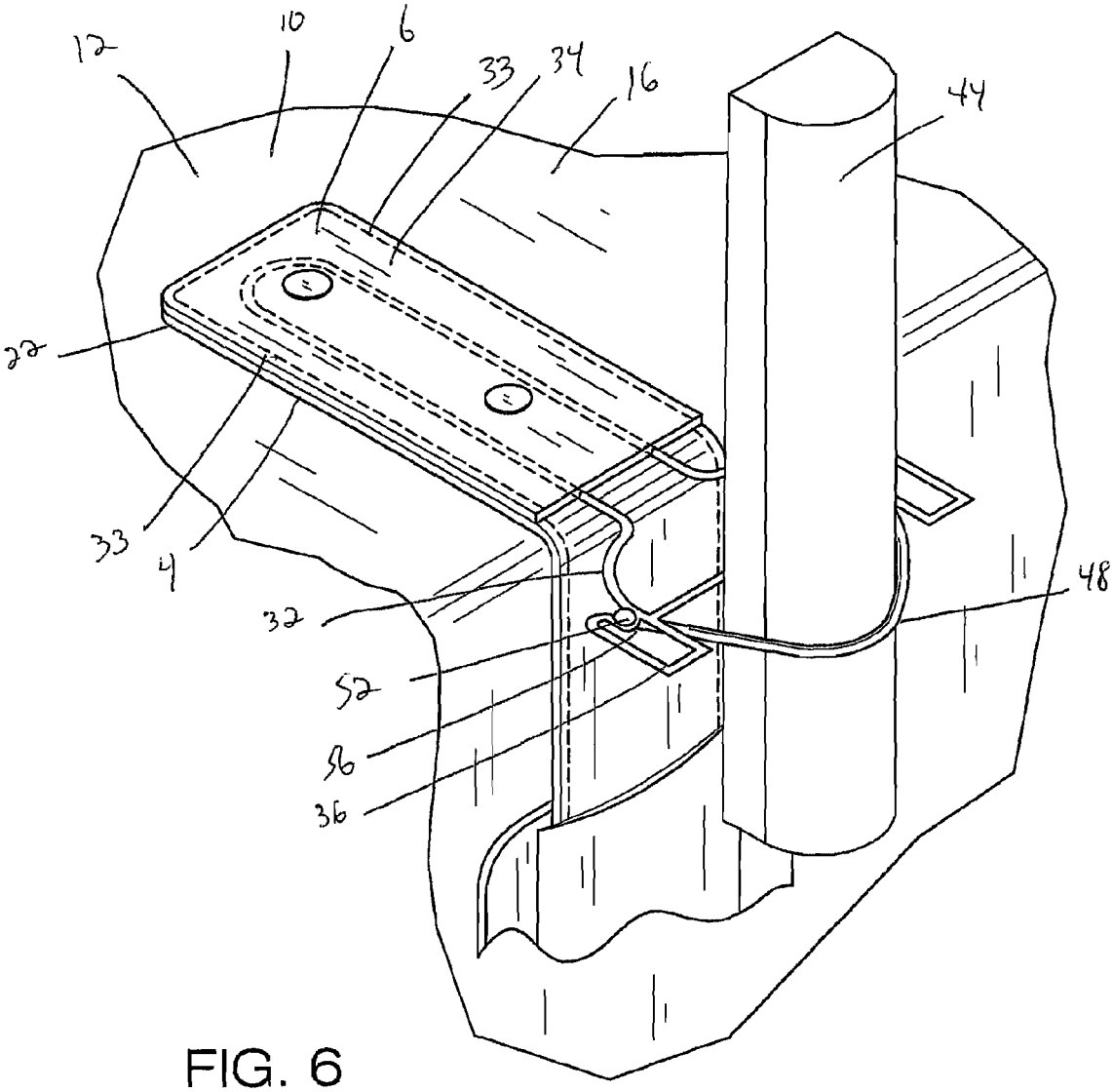
FIG. 6 shows a close-up perspective view of the guitar neck as it is shown attached to the leather strap with the wire frame and associated flexible cord.

With reference now to the drawings, and in particular to FIGS. 1 through 6 thereof, a new guitar mounting device embodying the principles and concepts of the present invention and generally designated by the reference numeral 2 will be described.

As best illustrated in FIGS. 1 through 6, the guitar mounting device 2 comprises a leather strap 4 that has two ends comprising a first end 6 and a second end 8. Essentially, the leather strap 4 is attached to the casing 10 of a stage amplifier 12 so that an individual can mount a guitar 14 to the amplifier 12.

The amplifier casing 10 itself has several surfaces, including a top surface 16, a bottom surface 18, and at least one side surface 20. The first end 6 of the leather strap 4 is removably attached to the top surface 16 of the amplifier casing 10 through attachment to a mounting plate 22. The mounting plate 22 is fixedly attached to the casing 10 of the amplifier 12 by inserting a fastener 21 through each of several installation holes 23 that are located on it. The mounting plate 22 also has a pair of female snap receptacles 24 and 26 on it. The first end 6 of the leather strap 4 has a pair of male snap receptacles 28 and 30 and is capable of being removably attached to the top surface 16 of the amplifier 12 by attaching male snap receptacle 28 to female snap receptacle 24 and male snap receptacle 30 to female snap receptacle 26.

The leather strap 4 further includes a wire frame 32 that is fixedly attached to the leather strap 4 through use of an extra leather piece 34. To effectively secure the strap 4 to the extra leather piece 34, an amount of stitching 33 is used to secure the two pieces of leather together. The wire frame 32 is preferably coated with a non-friction substance 36 such as rubber. The wire frame 32 is kept in close contact with the leather strap 4 because a portion of the wire frame 32 is fixedly attached to the leather strap 4 near the first end of the leather strap 4 by being wedged in between the extra leather piece 34 and the leather strap 4.

When this present invention is properly configured, a portion of the leather strap 4 is placed against the side surface 20 of the casing 10 of the amplifier 12. Over time, the leather strap 4 could potentially get worn down through constant use of the guitar mounting device 2. Therefore, a protective sleeve 50 is preferably placed over a substantial portion of the leather strap 4 that is immediately adjacent to the side surface 20 of the casing 10 of the amplifier in order to protect the face of the instrument.

The second end 8 of the leather strap 4 has a plurality of slits 40, with the plurality of slits preferably numbering three slits. More or less could be present, however, depending on the length of the leather strap 4. The second end 8 of the leather strap 8 is not designed to be attached to the casing 10 but is designed to be free.

The guitar body 14 includes a guitar body 42 and a guitar neck 44 attached to the guitar body 42. The guitar body 42 has two ends comprising a first end and a second end, with the first end of guitar body 42 having an external button 46 on it and the second end of the guitar body 42 being the end of the guitar body 42 that is attached to the guitar neck 44.

When mounting the guitar 14 on the device 2, the button 46 is designed to be inserted through a slit 40 on the second end of the leather strap 4, with the guitar neck 44 going upward. To secure the guitar neck 44, a flexible cord 48 is designed to attach the guitar 14 to the wire frame 32. The flexible cord 48 has two ends comprising a first end and a second end, with the cord 48 further having a pair of balls 52 and 54, with ball 52 being located on the first end of the cord 48 and ball 54 being located on the second end of the cord 48. Wire frame 32, in its preferred configuration, has a pair of loops 56 and 58, allowing the cord 48 to be removably fastened to the wire frame 32 by fastening ball 52 in loop 56 and ball 54 in loop 58 after the flexible cord 48 is laid over the guitar neck 44.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A guitar mounting device comprising:

a leather strap, the leather strap having two ends comprising a first end and a second end, hardware for mounting the leather strap to a guitar amplifier external casing or a block shaped fixed object external casing, a guitar, the guitar including a guitar body, the guitar also including a guitar neck attached to the guitar body, (order of limitations changed)

an element for protecting the face of the instrument, a fixture for mounting the guitar on the leather strap after the leather strap has been attached to a fixed object, wherein the element for protecting the face of the instrument comprises a protective sleeve, wherein the protective sleeve is placed over a portion of the leather strap, further wherein the protective sleeve is attached to the amplifier, wherein the hardware for mounting the leather strap to a fixed object further comprises a mounting plate, a fixture for attaching the mounting plate to the external casing of the amplifier, fixture for attaching the first end of the leather strap to the mounting plate, wherein the fixture for attaching the mounting plate to the external casing of the amplifier further comprises a plurality of installation holes located on the mounting plate, a plurality of fasteners, wherein the mounting plate is placed against the external casing of the amplifier, further wherein one fastener is inserted through each installation hole in the mounting plate to fasten the mounting plate to the external of the amplifier, wherein the fixture for attaching the first end of the leather strap to the mounting plate further comprises a pair of female snap receptacles comprising a first female receptacle and a second female snap receptacle, wherein the pair of female snap receptacles are attached to the mounting plate attached to the external casing of the amplifier, a pair of male snap receptacles comprising a first male receptacle and a second male snap receptacle, wherein the pair of male snap receptacles are attached to the first end of the leather strap, wherein the first female receptacle is attached to the first male receptacle, further wherein the second female receptacle is attached to the second male receptacle, wherein the fixture for mounting the guitar on the leather strap after the leather strap has been attached to a fixed object further comprises a retaining object attached to the leather strap, an element for attaching the retaining object to the first end of the leather strap, an element for connecting the guitar neck to the first end of the leather strap, an element for attaching the guitar head to the second end of the leather strap, wherein the retaining object is a wire frame, wherein the wire frame is coated with a non-friction substance, wherein the element for attaching the retaining object to the first end of the leather strap further comprises a piece of leather, an element for attaching the piece of leather to the first end of the leather strap, wherein a portion of the wire frame is wedged in between the first end of the leather strap and the piece of leather, wherein the element for attaching the piece of leather to the first end of the leather strap further comprises an amount of stitching, wherein the piece of leather is fixedly attached to the leather strap by the stitching, wherein the element for connecting the guitar neck to the first end of the leather strap further comprises a flexible cord, the flexible cord having two ends comprising a first end and a second end, wherein the flexible cord is placed over the guitar neck portion of the guitar, an element for attaching the flexible cord to the wire frame, wherein the element for attaching the guitar head to the second end of the leather strap further comprises a plurality of slits attached to the second end of the leather strap, an external button attached to the guitar body portion of the guitar, and wherein the external button is inserted through one of the slits of the plurality of slits on the second end of the leather strap prior to the attachment of the first end of the leather strap to the guitar neck.

2. A guitar mounting device according to claim 1 wherein the element for attaching the flexible cord to the wire frame further comprises (a) a pair of balls comprising a first ball and a second ball, wherein the first ball is attached to the first end of the flexible cord, further wherein the second ball is attached to the second end of the flexible cord, (b) a pair of loops comprising a first loop and a second loop, wherein the loops are located on the wire frame, (c) wherein the first ball is removably fastened to the first loop, and further wherein the second ball is removably fastened to the second loop.

3. A guitar mounting device comprising (a) a leather strap, the leather strap having two ends comprising a first end and a second end, (b) hardware for mounting the leather strap to a guitar amplifier external casing or a block shaped fixed object, said hardware further comprising (i) a mounting plate attached to the external casing of the amplifier, (ii) a fixture for attaching the mounting plate to the external casing of the amplifier, said means further comprising (1) a plurality of installation holes located on the mounting plate, (2) a plurality of fasteners, (3) wherein the mounting plate is placed against the external casing of the amplifier, (4) further wherein one fastener is inserted through each installation hole in the mounting plate to fasten the mounting plate to the external casing of the amplifier, and (iii) a fixture for attaching the first end of the leather strap to the mounting plate, said fixture further comprising (1) a pair of female snap receptacles comprising a first female receptacle and a second female snap receptacle, wherein the pair of female snap receptacles are attached to the mounting plate attached to the external casing of the amplifier, (2) a pair of male snap receptacles comprising a first male receptacle and a second male snap receptacle, wherein the pair of male snap receptacles are attached to the first end of the leather strap, (3) wherein the first female receptacle is attached to the first male receptacle, and (4) further wherein the second female receptacle is attached to the second male receptacle, (c) an element for protecting a portion of the leather strap, said means further comprising (i) a protective sleeve, (ii) wherein the protective sleeve is placed over a portion of the leather strap, (iii) further wherein the first the protective sleeve is attached to the amplifier, (d) a guitar, the guitar including a guitar body, the guitar also including a guitar neck attached to the guitar body, and (e) a fixture for mounting the guitar on the leather strap after the leather strap has been attached to a fixed object or an amplifier including an external casing, the external casing comprising several surfaces including at least one side surface, the external casing further comprising a top surface attached to the side surface, the external casing further comprising a bottom surface attached to the side surface, said means for mounting the guitar on the leather strap after the leather strap has been attached to a fixed object further comprising (i) a retaining object, the retaining object preferably being a wire frame, wherein the wire frame is coated with a non-friction substance, (ii) an element for attaching the retaining object to the first end of the leather strap, said element further comprising (1) a piece of leather attached to the first end of the leather strap, (2) means for attaching the piece of leather to the first end of the leather strap, said means further comprising an amount of stitching, wherein the piece of leather is fixedly attached to the leather strap by the stitching, (3) wherein a portion of the wire frame is wedged in between the first end of the leather strap and the piece of leather, (iii) means for connecting the guitar neck to the first end of the leather strap, said means comprising (1) a flexible cord, the flexible cord having two ends comprising a first end and a second end, wherein the flexible cord is placed over the guitar neck portion of the guitar, and (2) elements for attaching the flexible cord to the wire frame, said means for attaching the flexible cord to the wire frame further comprising a pair of balls comprising a first ball and a second ball, wherein the first ball is attached to the first end of the flexible cord, further wherein the second ball is attached to the second end of the flexible cord, said means for attaching the flexible cord to the wire frame further comprising a pair of loops comprising a first loop and a second loop, wherein the loops are located on the wire frame, wherein the first ball is removably fastened to the first loop, and further wherein the second ball is removably fastened to the second loop, (iv) an element for attaching the guitar head to the second end of the leather strap, said means comprising (1) a plurality of slits attached to the second end of the leather strap, (2) an external button attached to the guitar body portion of the guitar, (3) wherein the external button is inserted through one of the slits of the plurality of slits on the second end of the leather strap prior to the attachment of the first end of the leather strap to the guitar neck.

* * * * *